United States Patent [19]

Young, III

[11] Patent Number: 4,562,666

[45] Date of Patent: Jan. 7, 1986

[54] BURGLAR GUARD

[76] Inventor: Archie Young, III, P.O. Box 228, Hockley, Tex. 77447

[21] Appl. No.: 485,953

[22] Filed: Apr. 18, 1983

[51] Int. Cl.[4] ..... E05B 65/04

[52] U.S. Cl. ..... 49/62; 49/463

[58] Field of Search ..... 49/61, 62, 63, 50, 57, 49/463, 465; 52/788

[56] References Cited

U.S. PATENT DOCUMENTS

| | | | |
|---|---|---|---|
| 4,068,428 | 1/1978 | Peterson, III | 49/61 X |
| 4,143,733 | 3/1979 | Morello et al. | 49/463 X |
| 4,175,357 | 11/1979 | Goldhaber | 49/67 X |
| 4,368,226 | 1/1983 | Mucaria | 52/788 X |

*Primary Examiner*—Kenneth Downey

*Attorney, Agent, or Firm*—Neal J. Mosely

[57] ABSTRACT

A burglar guard for windows and doors is constructed of unbreakable, bullet-resistant transparent sheet material such as polycarbonate or Lexan plastic. The window guard comprises a generally planar, rectangular transparent sheet member having apertures in each of its corners which is installed on the interior of the building and covers existing conventional windows. Threaded studs are mounted in the wall studs adjacent to the existing window frame and the window guard is installed thereon by means of washers and threaded knobs for quick and easy installation and removal. A door guard is also constructed of the same unbreakable, bullet-resistant transparent sheet material and comprises a generally square, box shaped member enclosed on five sides. The door guard is installed on the exterior surface of the door and covers the existing conventional door knob. Holes are drilled through the door and rods integral with the door guard are inserted therethrough to protrude beyond the interior surface of the door and secured in position by knobs or pins installed on the ends of the rods. These guard attachments are inaccessible from the exterior of the building, but easily and quickly removed by an occupant from the inside.

1 Claim, 6 Drawing Figures fig.2
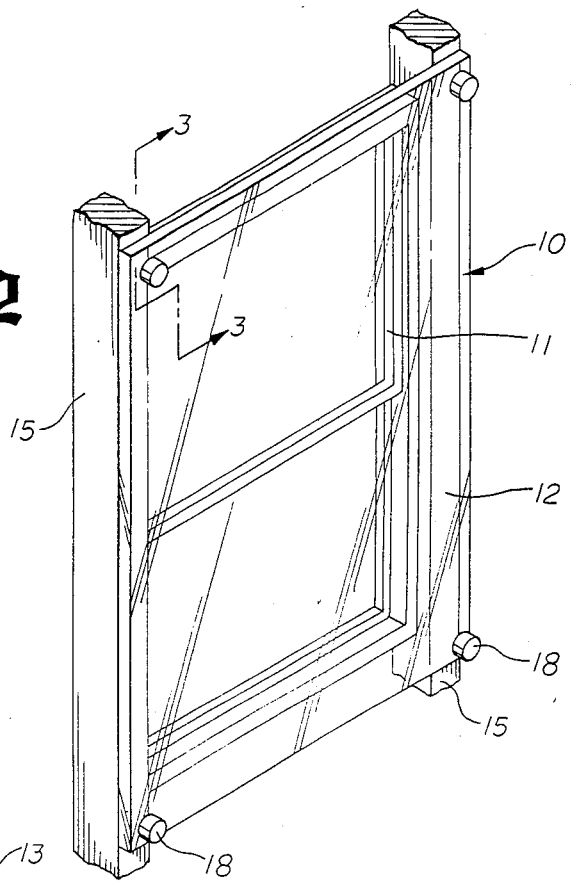
fig.1
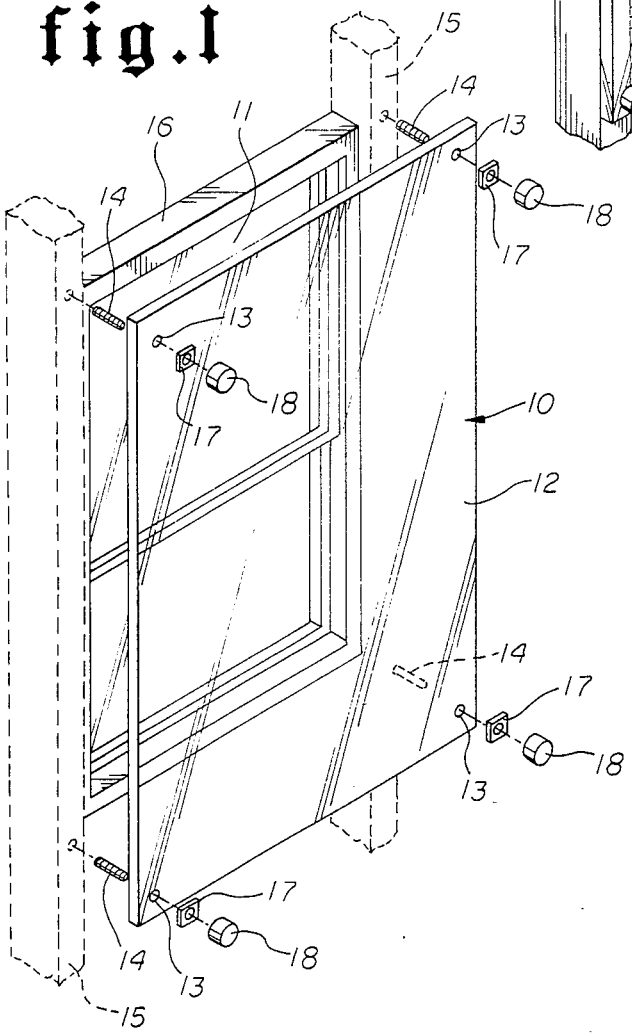
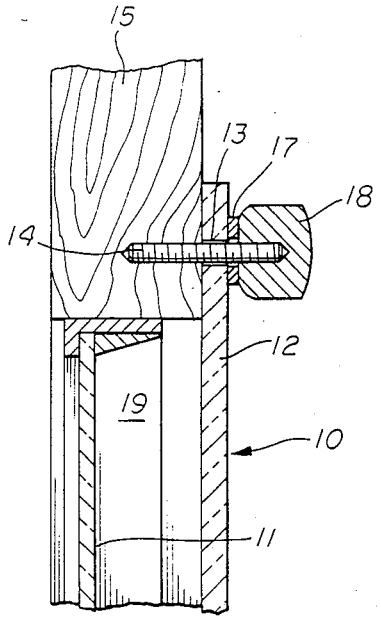
fig.3

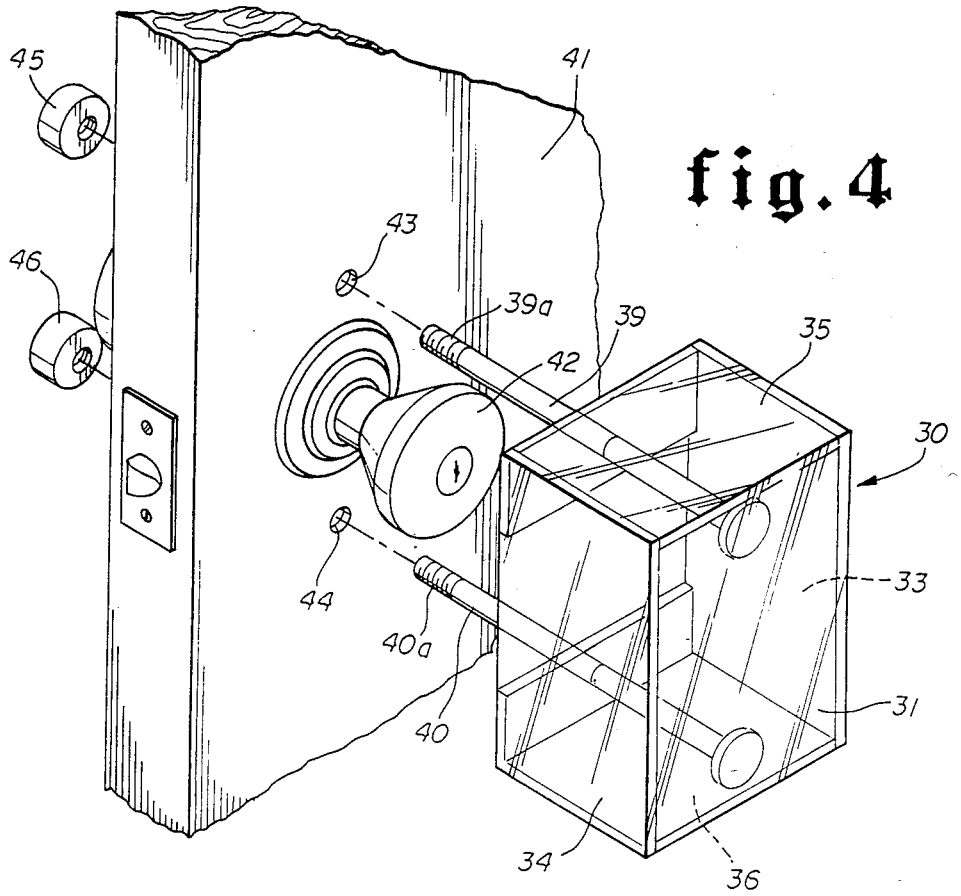
fig. 4
fig. 5
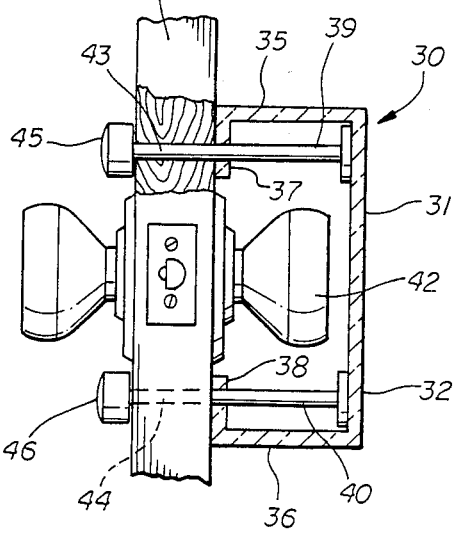
fig. 6
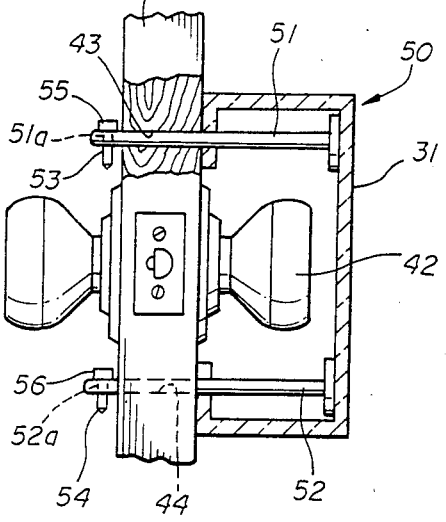

BURGLAR GUARD

BACKGROUND OF THE INVENTION

1. Field of the Invention

This invention relates to the field of burglar protection devices and more particularly to burglar guards for existing conventional windows and doors.

2. Brief Description of the Prior Art

Burglar protection devices are known in the art. The most common device being "burglar bars" which are wrought iron bars attached to the exterior of a building to cover existing windows and doors. Most prior art patents dealing with window covers are directed toward insulating windows and storm shutters.

Julien, U.S. Pat. No. 2,093,727 discloses and insulating window constructed of a glass pane mounted in a frame having an insulating seal. The insulating window frame is pivotally attached to the sash of a conventional window.

Goodman, U.S. Pat. No. 2,012,388 discloses a steel storm shutter removably attached to the exterior surface of a conventional window sash. The attachment means are located on the exterior side of the window frame.

Korany, U.S. Pat. No. 4,196,545 discloses a removable window structure comprising a glass or acrylic resin window pane mounted in a frame. The frame contains wire springs to bias the frame members outwardly from the pane so that the frame will fit the periphery of conventional window frames. Knobs on the frame serve to facilitate installation and removal of the structure. The structure cooperates with conventional windows to act as a double pane. The material used is not resistant to breakage and the attachment means would make it unsuitable for burglar protection.

Ruiz, U.S. Pat. No. 4,070,882 discloses a lock shielding assembly used to cover dead bolt type door locks. The assembly comprises a housing containing a longitudinal slot to receive a shield plate and a hole in its center which covers the key hole. A series of pins retain the shield plate in the housing. A cover plate covers the housing and is locked thereto. The user must unlock and remove the cover plate, then remove selected pins to remove the shield plate and expose the key hole.

Oliver, U.S. Pat. No. 4,226,104 discloses a removable protector for locks comprised of a metal ring mounted around a door knob. A dome shaped housing having a permanent magnet in its base covers the door knob. The magnetic force holds the housing onto the ring. A lever is provided to enable the user to remove the housing when desired.

The prior art in general, and none of these patents in particular, disclose the present invention which comprises burglar guards for existing conventional windows and doors constructed of unbreakable, bullet-resistant material having attachment means inaccessible from the exterior of a building.

SUMMARY OF THE INVENTION

An object of the invention to provide a burglar guard for conventional windows and doors constructed of unbreakable, bullet-resistant transparent sheet material.

Another object of this invention to provide a burglar guard that is economical to manufacture and simple to install.

Still another object of this invention to provide a burglar guard having attachment means inaccessible from the exterior of a building, but are easily and quickly removed by the occupant from the interior of the building.

Another object of this invention is to provide a burglar guard which allows complete visibility and has an attractive appearance.

Another object of this invention is to provide a burglar guard which has insulating properties as well protection from theft.

Other objects of the invention will become apparent from time to time throughout the specification and claims as hereinafter related.

The above noted objects and other objects of the invention are accomplished by burglar guards, for existing conventional windows and doors, constructed of unbreakable, bullet-resistant transparent sheet material having attachment means inaccessible from the exterior of a building. The window guard comprises a generally planar, rectangular transparent sheet member having apertures in each of its corners for installation on the window frame by means of quickly removable threaded knobs.

The door guard comprises a generally square, box shaped member enclosed on five sides installed on the exterior surface of the door to cover the existing conventional door knob. The door guard is secured by quickly removable threaded knobs or pins located on the other side of the door.

BRIEF DESCRIPTION OF THE DRAWINGS

FIG. 1 is an exploded isometric view of a burglar guard prior to installation on an existing window.

FIG. 2 is an isometric view of a burglar guard installed on a conventional window.

FIG. 3 is a longitudinal cross sectional view of the attachment means taken along line 3—3 of FIG. 2.

FIG. 4 is an exploded isometric view of a burglar guard prior to installation on an existing door.

FIG. 5 is a partially cross sectioned end view of a burglar guard installed on a conventional door.

FIG. 6 is a partially cross sectioned end view of a burglar guard installed on a conventional door by an alternate means of attachment.

DESCRIPTION OF THE PREFERRED EMBODIMENT

Referring to the drawings by numerals of reference, and more particularly to FIGS. 1, 2, and 3, there is shown a window burglar guard 10 for installation on a window 11. The window burglar guard 10 comprises a generally planar, rectangular panel 12. Panel 12 is constructed of substantially unbreakable, bullet-resistant, transparent sheet material such as polycarbonate or Lexan plastic. The term "bullet-resistant", as used herein, means that the material is not penetrated or broken readily by low-velocity, small caliber bullets. Panel 12 is provided with apertures 13 in each of its corners. The window burglar guard 10 is installed on the interior of a building structure. Threaded studs 14, with wood screws at one end and screw threads at the other end, are conventionally mounted in the existing wall studs 15 adjacent to the existing window frame 16 and the window burglar guard 10 is installed thereon.

Square washers 17, made of the polycarbonate plastic, are placed on the threaded studs 14, and threaded knobs 18 are then hand threaded thereon to secure the panel 12 in position on the inside of and spaced from the window 11. It should be noted that when the window 11 is closed and the panel 12 is in place, a dead air space 19 is formed therebetween thus providing the additional benefit of a thermal insulating barrier.

By attachment in this manner, the attaching means are located inside the building and are inaccessible from the outside even though the window pane may be broken or opened by a burglar. The occupant however, may quickly unscrew the knobs 18 and remove the panel 12, in the event of an emergency.

Referring now to FIGS. 4 and 5, a door burglar guard 30 is shown. The door burglar guard 30 is also constructed of unbreakable, bullet-resistant material and comprises a generally square, box shaped member 31 enclosed on five sides 32–36. Sides 35 and 36 are provided with inwardly extending lips 37 and 38 to prevent marring the door surface. Rods 39 and 40 extend outwardly from the box shaped member 31 and their extended ends are provided with threads 39*a* and 40*a*. Rods 39 and 40 may be molded integrally with the box member 31, or attached by other means such as epoxy. The door burglar guard 30 is installed on the exterior surface of a conventional door 41 and covers the existing door knob 42.

Holes 43 and 44 are drilled through the door 41 and rods 39 and 40 are inserted therethrough to protrude beyond the interior surface of the door 41. The door burglar guard 30 is secured in position by hand threading knobs 45 and 46 onto the protruding ends 39*a* and 40*a* of the rods 39 and 40. The door burglar guard attachment means are inaccessible from the exterior of the building, but are easily and quickly removed by the occupant from the interior of the building.

FIG. 6 shows an alternate door burglar guard 50. The door burglar guard 50 is exactly the same as the previously described burglar door guard 30 with the exception of the rods 51 and 52 which extend outwardly from the box shaped member 31. The rods 51 and 52 in this embodiment are provided with holes 51*a* and 52*a* at their extended ends. The door burglar guard 50 is installed on the exterior surface of a conventional door 41 and covers the existing door knob 42.

Holes 43 and 44 are drilled through the door 41 and rods 51 and 52 are inserted therethrough to protrude beyond the interior surface of the door 41. The door burglar guard 30 is secured in position by inserting pins 53 and 54 into holes 51*a* and 52*a* in the protruding ends of the rods 51 and 52. The pins 53 and 54 are smaller in diameter than the holes 51*a* and 52*a* so they may be quickly and easily inserted and removed. The pins 53 and 54 are provided with a head portion 55 and 56 which is larger in diameter than the holes 51*a* and 52*a* to prevent them from dropping through the holes 51*a* and 52*a*.

While this invention has been described fully and completely with special emphasis upon a preferred embodiment, it should be understood that within the scope of the appended claims the invention may be practiced otherwise than as specifically described herein.

I claim:

1. A burglar guard system comprising, in combination, a building having at least one exterior window supported by supporting building frame members, a removable burglar guard for said window comprising a generally planar, rectangular panel constructed of substantially unbreakable, bullet-resistant, thick sheet of transparent, polycarbonate plastic positioned to cover the inside of said window, said rectangular panel having apertures in each of its corners, and means located inside said building, inaccessible from outside the structure, cooperable with said apertures for attaching said panel over the inside of said window in a fixed secure relation to said frame members and covering said window, whereby said guard is effective to secure said window against forcible entry, said attaching means comprising threaded studs having one end portion with wood screws mounted in said supporting frame members and having metal screws on the opposite ends to cooperate with said panel apertures, washers cooperable with said studs and apertures, and threaded knobs of a size for hand operation, hand threadable onto said studs, and inaccessible from outside said building to secure said rectangular panel firmly in position.

* * * * *